US008479701B2

(12) United States Patent
Song et al.

(10) Patent No.: US 8,479,701 B2
(45) Date of Patent: Jul. 9, 2013

(54) CORROSION RESISTANT INSERT FOR A CYLINDER HEAD

(75) Inventors: Guangling Song, Troy, MI (US); Blair E. Carlson, Ann Arbor, MI (US); Dale A. Gerard, Bloomfield HIlls, MI (US); Ping-Ho Tsai, Troy, MI (US); Johnnie M. Williams, Clarkston, MI (US); Pui-Kei Yuen, Rochester Hills, MI (US); David L. Moore, Madison Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 742 days.

(21) Appl. No.: 12/685,193

(22) Filed: Jan. 11, 2010

(65) Prior Publication Data

US 2010/0313842 A1 Dec. 16, 2010

Related U.S. Application Data

(60) Provisional application No. 61/186,952, filed on Jun. 15, 2009.

(51) Int. Cl.
*F01L 3/00* (2006.01)

(52) U.S. Cl.
USPC ..... 123/188.8; 123/188.6

(58) Field of Classification Search
USPC ..... 123/188.1–188.2, 188.4, 188.14, 123/190.16, 188.6, 188.8, 188.9, 188.11, 123/198 E; 29/888.4, 888.44
See application file for complete search history.

(56) References Cited

U.S. PATENT DOCUMENTS

| | | | | |
|---|---|---|---|---|
| 1,949,614 | A * | 3/1934 | McDonald | 123/188.8 |
| 2,101,970 | A * | 12/1937 | Wissler | 123/188.8 |
| 2,369,025 | A * | 2/1945 | Cummings | 123/188.8 |
| 2,585,658 | A * | 2/1952 | Keller | 251/363 |
| 6,260,531 | B1 * | 7/2001 | Haan et al. | 123/188.8 |

FOREIGN PATENT DOCUMENTS

| | | |
|---|---|---|
| CN | 1902381 A | 1/2007 |
| JP | 2002097913 A | 4/2004 |

* cited by examiner

*Primary Examiner* — Noah Kamen
*Assistant Examiner* — Hung Q Nguyen
(74) *Attorney, Agent, or Firm* — Quinn Law Group, PLLC

(57) ABSTRACT

An engine includes a cylinder head at least partially defining a valve seat pocket. A valve seat is located proximate to the cylinder head to at least partially define the valve seat pocket. A pocket filler is located between the valve seat and the pocket insert such that the pocket filler occupies a substantial portion of the valve seat pocket. A pocket insert is attached to the cylinder head proximate to the valve seat pocket, such that the pocket insert lines at least a portion of the valve seat pocket.

11 Claims, 1 Drawing Sheet

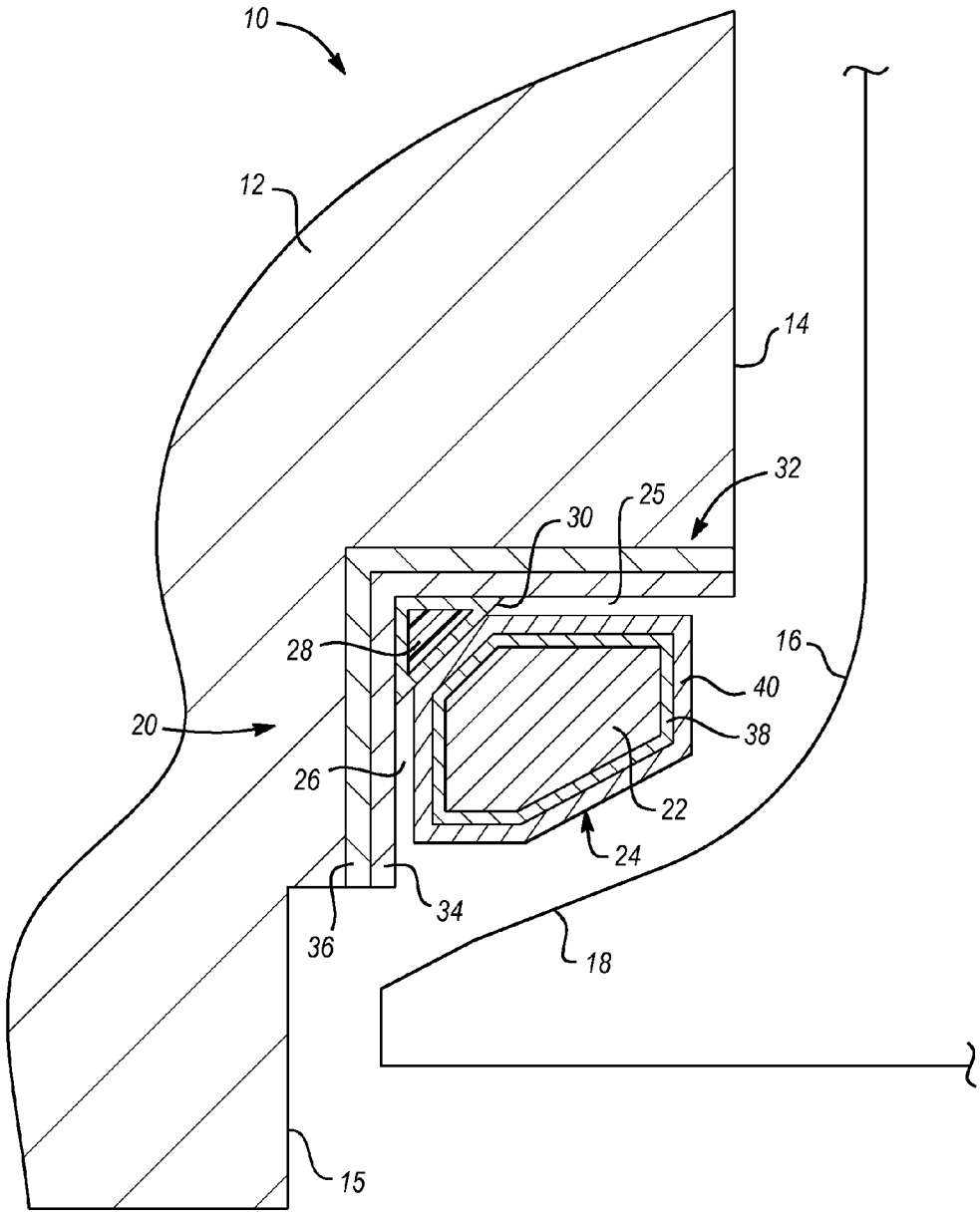
10
12
14
32
25
30
28
16
40
38
20
26
22
24
34
36
18
15

CORROSION RESISTANT INSERT FOR A CYLINDER HEAD

CROSS-REFERENCE TO RELATED APPLICATIONS

This application claims the benefit of and priority to U.S. Provisional Patent Application No. 61/186,952, filed Jun. 15, 2009, which is hereby incorporated by reference in its entirety.

TECHNICAL FIELD

The present invention relates, generally, to an engine, and more specifically, to an arrangement for preventing corrosion of the cylinder head.

BACKGROUND OF THE INVENTION

Cylinder heads commonly include valve seats to provide a seating surface for the engine valves. The valve seats are typically inserts that are positioned within the cylinder head. Valve seats are typically manufactured from materials that are wear-resistant and heat-resistant. Often the valve seat is manufactured from a different material than the cylinder head. For example, aluminum engine cylinder heads commonly have steel valve seats.

SUMMARY OF THE INVENTION

An engine includes a cylinder head, a valve seat, and a pocket filler. The cylinder head at least partially defines a valve opening configured to receive a valve, a combustion chamber, and a stepped portion disposed between the valve opening and the combustion chamber. The valve seat may be disposed within the stepped portion and may be configured to make sealing contact with the valve to fluidly isolate the valve opening from the combustion chamber.

The pocket filler may be disposed within the stepped portion and between the cylinder head and the valve seat. The pocket filler may be formed from an elastic material configured to permit relative movement between the valve seat and the cylinder head. The cylinder head, the valve seat, and the pocket filler may collectively define a first valve seat pocket and a second valve seat pocket. The first valve seat pocket may be in fluid communication with the valve opening when sealing contact is established between the valve seat and the valve. Likewise, the second valve seat pocket may be in fluid communication with the combustion chamber when sealing contact is established between the valve seat and the valve.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 1 is a schematic cross-sectional illustration of an engine showing an cylinder head and valve seat.

DESCRIPTION OF THE PREFERRED EMBODIMENTS

Referring to the Figures, wherein like reference numbers refer to the same or similar components throughout the several views, FIG. 1 schematically illustrates an engine 10 having a cylinder head 12 that at least partially defines a valve opening 14 and a combustion chamber 15. A valve 16 is located within the valve opening 14 and includes a valve head 18. The cylinder head 12 also defines a stepped portion 20 for aligning a valve seat 22. The cylinder head 12 is preferably an aluminum alloy and the valve seat 22 is preferably a steel alloy. The valve seat 22 may be disposed within the stepped portion 20 and may be positioned to provide a seating surface 24 for the valve head 18 during operation of the engine 10. Contact between the valve head 18 and the seating surface 24 of the valve seat 22 may be operative to fluidly isolate the valve opening 14 from the combustion chamber 15.

A valve seat pocket filler 28 may be disposed within the stepped portion 20 between the cylinder head 12 and the valve seat 22. The valve seat pocket filler 28 is formed in the general shape of the stepped portion 20 and manufactured from a material that inhibits corrosion of aluminum. Alternatively, the valve seat pocket filler 28 may have a common shape, such as an O-ring having a circular cross-sectional shape.

As illustrated in FIG. 1, the cylinder head 12, the valve seat 22, and the pocket filler 28 may define a first valve seat pocket 25 and may define a second valve seat pocket 26. The first valve seat pocket 25 may be in fluid communication with the valve opening 14 when sealing contact is established between the valve seat 22 and the valve head 18. In a similar manner, the second valve seat pocket 26 may be in fluid communication with the combustion chamber 15 when sealing contact is established between the valve seat 22 and the valve head 18.

The valve seat pocket filler 28 is preferably a rubber-based material which is chemically stable Likewise, the valve seat pocket filler 28 may be formed from an elastic material to accommodate movement of the valve seat 22 relative to the cylinder head 12. For example, the valve seat pocket filler 28 may be formed from a fluorelastomer, a fluoropolymer (e.g., Polytetrafluoroethylene), or a phenolic material.

The valve seat pocket filler 28 may be larger than the stepped portion 20 of the cylinder head 12, such that the valve seat pocket filler 28 is under compression when the valve head 18 is resting on the valve seat 22. The valve seat pocket filler 28 may substantially occupy the stepped portion 20 of the cylinder head 12 to prevent the stepped portion 20 from filling with engine fuel. Therefore, the valve seat pocket filler 28 prevents fuel from becoming trapped in the stepped portion 20 in a manner where it cannot be easily evacuated, and also prevents corrosion of the cylinder head 12, which may result when the engine fuel is a bio-fuel and the cylinder head 12 is formed of an aluminum alloy. The valve seat pocket filler 28 may also be bonded in place to assist the valve seat pocket filler 28 in filling the stepped portion 20.

The valve seat pocket filler 28 may also have a coating 30 of material applied to the surface which is known to have an inhibiting effect on the corrosion of aluminum. For example, the material for the coating 30 may be colloids such as tragacanth, acacia, agar-agar, glue, dextrin, or gelatin. Additional materials known to have an inhibiting effect on the corrosion of aluminum may also be mixed with the colloids for the coating 30 of the valve seat pocket filler 28. For example, aldehydes, sebacic axis, phenyl semicarbazide derivatives, amines, cerium dibuytlphosphates, citric acid, azodyes, anion, pyridine, surfactants, Vernonia amygdalina, Halide ions, 2-acetylphenothiazine, methyl red, TSC (Thiosemicarbazone), Lawsonia extract (Henna, aqueous extract of Rosmarinus officinalis L, methylene blue, Hibiscus subdariffa (Karkode) extract, molasses, caffeine, 4-(2'-amino-5'-methylphenylazo) antipyrine, Zenthoxylum alatum plant, extract of the leaves of Nypa fruticans (Wurmb), or vanadates may be mixed with the colloids to form the coating 30. Therefore, the valve seat pocket filler 28 may release inhibitors to prevent corrosion of the cylinder head 12 proximate to the stepped portion 20.

A pocket insert 32 may also be secured to the cylinder head 12 at the stepped portion 20. The pocket insert 32 provides a liner for the cylinder head 12 along the stepped portion 20 and assists in preventing corrosion of the valve seat 22 and the cylinder head 12 adjacent the first and second valve seat pockets 25, 26. In one embodiment, the pocket insert 32 is a steel insert that is preformed and secured to the cylinder head 12 at the stepped portion 20 during casting of the cylinder head 12. That is, the pocket insert 32 may be placed in the mold for the cylinder head 12 such that the cylinder head 12 is formed around the pocket insert 32 during casting.

The pocket insert 32 may also include a first layer 34 formed of a first material and a second layer 36 formed of a second material. The first and the second materials may be selected to increase the corrosion protection of the cylinder head 12 at the first and second valve seat pockets 25, 26. The first layer 34 may be adjacent the valve seat 22 and the second layer 36 may be adjacent the cylinder head 12. Alternately, the second layer 36 may be a cladding applied around the first layer 34. In either of these embodiments, the first layer 34 may be steel to assist in preventing corrosion and the second layer may be aluminum to improve the bond that forms between the cylinder head 12 and the pocket insert 32 during casting of the cylinder head 12. Alternately, there may be tabs located on the pocket insert 32 to mechanically bond the pocket insert 32 to the cylinder head 12 during casting of the cylinder head 12.

The valve seat pocket filler 28 can be secured to the valve seat 22 or to the cylinder head 12 by attachment to the pocket insert 32. Adhesive material may be used to secure the valve seat pocket filler 28 to the valve seat 22 or the pocket insert 32.

The valve seat 22 includes a first valve seat coating 38. The first valve seat coating 38 is preferably a ceramic coating. The first valve seat coating 38 may be created by applying an aluminum coating to the surface of the valve seat 22 such as by an Alumiplate™ technique, as is known to those skilled in the art. The aluminum coating is then converted into a ceramic coating such as through an electro-deposition technique like Anodine EC2™, as is known to those skilled in the art. The resulting first valve seat coating 38 has high corrosion resistance and high wear resistance. By first applying an aluminum coating and then converting the aluminum to ceramic, there is a higher level of adhesion between the first valve seat 22 and the first valve seat coating 38. The valve seat coating 38 prevents fretting wear on the valve seat 22 during operation of the engine 10

The valve seat 22 may also include a second valve seat coating 40. The second valve seat coating 40 may be a material applied to the surface of the first valve seat coating 38, which is known to have an inhibiting effect on the corrosion of aluminum. For example, aldehydes, sebacic axis, phenyl semicarbazide derivatives, amines, cerium dibuytlphosphates, citric acid, azodyes, anion, pyridine, surfactants, or vanadates, etc. may be mixed with the a base material to form the second valve seat coating 40. The base material for the second valve seat coating 40 may be a hard material such as ceramic. Alternatively, the inhibitor may be directly incorporated into the first valve seat coating 38. The second valve seat coating 40 may be formed about the entire circumference of the valve seat 22, as shown, or may be applied to areas where the inhibitor may have the most effect, such as adjacent to the first and second valve seat pockets 25, 26. Therefore, the valve seat pocket seat 22 may release inhibitors to prevent corrosion of the engine bock head 12 proximate to the first and second valve seat pockets 25, 26.

In the embodiment described above, the valve seat pocket filler 28, the pocket insert 30, first the valve seat coating 38, and the second valve seat coating 40 are all used within the engine 10. However, each of these elements may be utilized individually or in combination with one another to promote resistance to corrosion within the engine 10.

While the best modes for carrying out the invention have been described in detail, those familiar with the art to which this invention relates will recognize various alternative designs and embodiments for practicing the invention within the scope of the appended claims.

The invention claimed is:

1. An engine comprising:

a cylinder head at least partially defining:

a valve opening configured to receive a valve;

a combustion chamber; and a stepped portion disposed between the valve opening and the combustion chamber;

a valve seat disposed within the stepped portion and configured to make sealing contact with the valve to fluidly isolate the valve opening from the combustion chamber;

a pocket filler disposed within the stepped portion and between the cylinder head and the valve seat, the pocket filler formed from an elastic material configured to permit relative movement between the valve seat and the cylinder head;

wherein the cylinder head, the valve seat, and the pocket filler collectively define both a first valve seat pocket and a second valve seat pocket;

wherein the first valve seat pocket is in fluid communication with the valve opening when sealing contact is established between the valve seat and the valve; and wherein the second valve seat pocket is in fluid communication with the combustion chamber when sealing contact is established between the valve seat and the valve.

2. The engine of claim 1, further comprising a pocket insert secured to the cylinder head within the stepped portion; and wherein the pocket insert lines at least a portion of the first valve seat pocket and the second valve seat pocket.

3. The engine of claim 2, wherein the pocket insert includes a first material layer and a second material layer, the second material layer being disposed between the cylinder head and the first material layer.

4. The engine of claim 3, wherein the first material layer includes steel; and wherein the second material layer includes aluminum.

5. The engine of claim 1, wherein the pocket filler is secured to one of the valve seat and the pocket insert.

6. The engine of claim 1, wherein the valve seat is formed from a steel alloy, and includes a first valve seat coating disposed about the steel alloy; and wherein the first valve seat coating includes a ceramic material.

7. The engine of claim 6, wherein the valve seat further includes a second valve seat coating disposed about the first valve seat coating; and wherein the second valve seat coating inhibits the corrosion of aluminum.

8. The engine of claim 7, wherein the second valve seat coating includes a material having at least one component compound selected from the group of an aldehyde, a phenyl semicarbazide derivative, an amine, a cerium dibuytlphosphate, citric acid, an azodye, an anion, a pyridine, a surfactant, and a vanadate.

9. The engine of claim 1, wherein the pocket filler includes at least one of a fluorelastomer, a fluorpolymer, and a phenolic material.

10. The engine of claim 1, wherein the pocket filler includes a coating having at least one of a corrosion inhibitor and a corrosion passivator to prevent corrosion of the valve seat and the cylinder head.

11. The engine of claim 10, wherein the pocket filler coating includes at least one of tragacanth, acacia, agar-agar, glue, dextrin, gelatin, aldehyde, sebacic acid, phenyl semicarbazide derivative, amine, cerium dibuytlphosphate, citric acid, azodye, anion, pyridine, surfactant, Vernonia amygdalina, Halide ions, 2-acetylphenothiazine, methyl red, TSC (Thiosemicarbazone), Lawsonia extract (Henna), aqueous extract of Rosmarinus officinalis L, methylene blue, Hibiscus subdariffa (Karkode) extract, molasses, caffeine, 4-(2'-amino-5'-methylphenylazo) antipyrine, Zenthoxylum alatum plant, extract of the leaves of Nypa fruticans (Wurmb), and vanadate.

* * * * *